United States Patent [19]

Kohler

[11] 4,112,275

[45] Sep. 5, 1978

[54] CONTACT STRUCTURE FOR ELECTRICAL SWITCHING APPARATUS

[75] Inventor: Helmut Kohler, Amberg, Germany

[73] Assignee: Siemens Aktiengesellschaft, Berlin & Munich, Germany

[21] Appl. No.: 703,583

[22] Filed: Jul. 8, 1976

Related U.S. Application Data

[63] Continuation of Ser. No. 453,401, Mar. 21, 1974, abandoned.

[30] Foreign Application Priority Data

Mar. 26, 1973 [DE] Fed. Rep. of Germany ... 7311345[U]

[51] Int. Cl.[2] ..... H01H 33/20

[52] U.S. Cl. ..... 200/147 R; 200/144 R

[58] Field of Search ..... 200/144 R, 147 R

[56] References Cited

U.S. PATENT DOCUMENTS 3,483,343 12/1969 Heft ..... 200/147 R 3,801,760 4/1974 Korte ..... 200/147 R

FOREIGN PATENT DOCUMENTS 994,363 6/1965 United Kingdom ..... 200/147 R

*Primary Examiner*—Robert S. Macon

*Attorney, Agent, or Firm*—Kenyon & Kenyon, Reilly, Carr & Chapin

[57] ABSTRACT

An improved contact structure for an electrical switching apparatus including stationary and movable electrical contacts comprising an electrical arc conducting member constructed of ferromagnetic material, and an electrical contact member, disposed on the electrical arc conducting member for engagement with an opposing contact of the switching apparatus, and constructed of non-magnetic material.

4 Claims, 3 Drawing Figures

CONTACT STRUCTURE FOR ELECTRICAL SWITCHING APPARATUS

This is a continuation of application Ser. No. 453,401 filed Mar. 21, 1974 now abandoned.

BACKGROUND OF THE INVENTION

1. Field of the Invention

This invention relates generally to electrical switching apparatus, and in particular to an improved structure for the stationary contacts of such apparatus.

2. Description of the Prior Art

German Pat. No. 623,700 discloses a switching apparatus including electrical contacts constructed of nonmagnetic material and arc conducting members constructed of ferromagnetic material. In that apparatus, a pin shaped switch contact, which is constructed of copper, bronze or brass, is provided with a recess at an end face thereof not suited for the formation of a permanent contact. A ferromagnetic member, constructed, for example, of iron, is disposed in this recess in order to cause the bases of electrical arcs generated during opening of the switching apparatus to move away from the switch contacts by means of electromagnetic force. Such a structural arrangement, i.e., one including a ferromagnetic member, is costly and can be utilized only in conjunction with heavy switching contacts.

German Pat. No. 317,407 discloses an electrical switching apparatus in which a contact carrier member is constructed of less electrically conductive material than the contacts and which includes an electrically conductive plating of copper or brass disposed in the regions thereof which affect current transfer and interruption. The plating is applied in a thickness which is sufficient to render the electrical resistance thereof low and the durability thereof high with respect to damage caused by arcing. Thus, the contact carrier of this apparatus does not serve as an arc conducting bar.

SUMMARY OF THE INVENTION

It is therefore an object of the invention to overcome the above described disadvantages of heretofore known switching apparatus and to provide a simple, inexpensive and improved contact structure for such apparatus.

These and other objects are achieved by an improved contact structure comprising an electrical arc conducting member constructed of ferromagnetic material, and an electrical contact member disposed on the electrical arc conducting member for engagement with an opposing contact of the switching apparatus. The electrical contact member is constructed of non-magnetic material.

In a preferred form of the invention the contact member is a stationary contact member, and a layer of copper metal is plated on the electrical arc conducting member at least on the side thereof on which the electrical contact member is disposed between the latter and the arc conducting member, and a conductor of the electrical line to which the apparatus is connected is coupled to the arc conducting member at a point away from the electrical contact member, and preferably on the side thereof which is disposed opposite the contact member. The advantages of these and other specific features of the invention will be described in the following detailed description.

DETAILED DESCRIPTION

Figure 1:
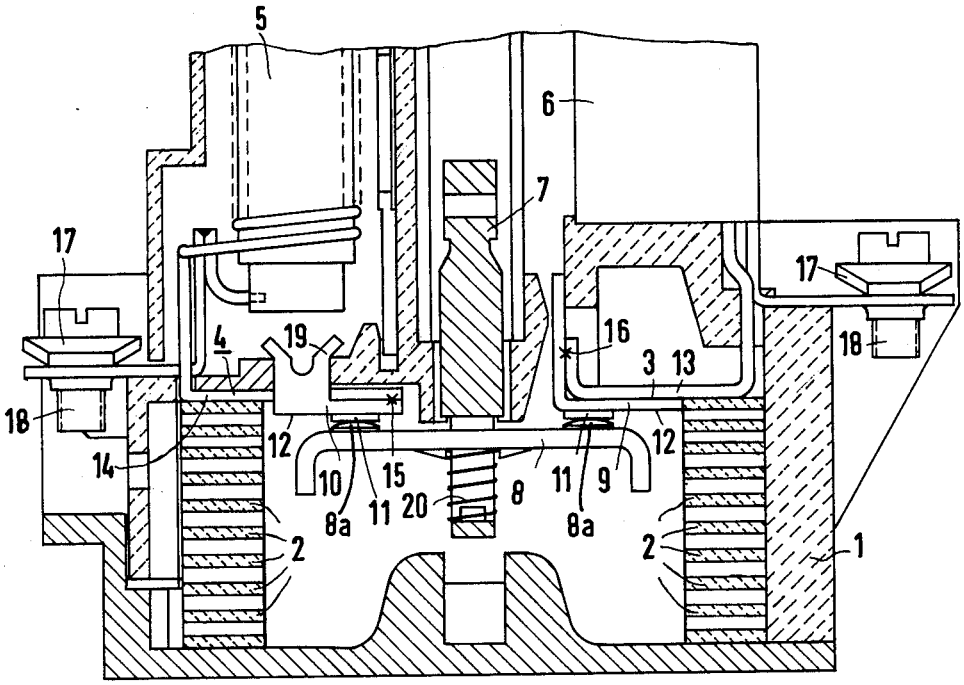
FIG. 1 is a sectional view of an electrical switching apparatus including the improved contact structure of the invention.
Figure 2:
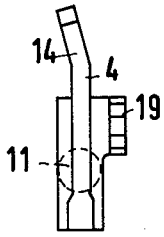
FIG. 2 is a top plan view of the contact structure constructed according to the invention.
Figure 3:
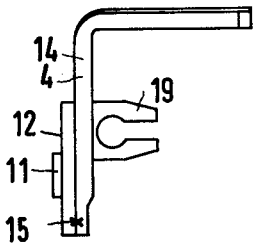
FIG. 3 is a side view of the contact structure illustrated in FIG. 2.

Referring now to the drawings there is shown an electrical contact apparatus of conventional type including a housing 1 and an arc quenching arrangement 2 consisting of a plurality of permeable ceramic members. Stationary electrical contacts 3 and 4, a bimetal tripping device 5, and a short-circuit, quick release protective mechanism 6 are also provided. A movable electrical contact bridge carrier 7 holds a contact bridge 8 and is movable within housing 1 in response to the tripping device, protective mechanism, and a switch lock (not shown). Electrical contacts **8*a* are disposed on bridge 8 for engagement with the stationary electrical contacts of the switching apparatus. Bridge 8 is movable axially along one end of carrier 7, and is secured thereon by a coil spring 20** which also serves to provide pressure for maintaining contact between the movable and stationary electrical contacts.

In accordance with the invention, each of the fixed electrical contacts includes an electrical arc conducting member, designated 9 and 10, which is constructed of ferromagnetic material. On this arc conducting member is disposed an electrical contact member, designated 11, which is constructed of nonmagnetic material. Each of the contact members is positioned on the arc conducting members for engagement with the movable contacts **8*a* on bridge 8. A layer of copper metal is preferably plated on each of the arc conducting members at least on the side thereof on which electrical contact members 11 are disposed. The plating of copper metal is interposed between the contact members and the arc conducting members and serves to assure good electrical conductivity between the contact members 11 and arc conducting members 9 and 10. The copper layer also provides a base for a good solder connection between the arc conducting members and electrical contact members, especially with sintered materials. The conductors 13 and 14 of an electrical line are connected to the arc conducting members, by welding, for example, at a point away from the electrical contact members 11, illustrated in the drawings as welding points 15 and 16. This type of connection induces travel of the electrical arcs by forming a current loop and keeps the resistance opposed to the current flow, which is high in ferromagnetic type materials, as low as possible. This connection of the line conductors to the arc conducting member is preferably made, as shown in the drawings, to the side of each arc conducting member which is opposite that on which electrical contact members 11** are disposed. This arrangement minimizes the voltage drop caused by the ferromagnetic arc conducting members but does not affect the current loop action on the electrical arcs produced during separation of the electrical contacts. Moreover, the arc conducting members shield the magnetic field of the electrical line lead in such an arrangement.

Each of the electrical arc conducting members may also include means for mounting the arc conducting members and the electrical contact members within housing 1. In the illustrated embodiment of the invention, this means comprises a stamped member 19 which is affixed to the arc conducting members 9 and 10 and includes a keyhole shaped slot. When member 19 is secured by suitable means to housing 1 of the apparatus, the arc conducting members, electrical contact members, and the electrical line conductors are securely positioned in housing 1. Member 19 is of particular advantage if the arc conducting members are fabricated as stamped and bent members.

The above described structural configuration provides an effective, simple arc travel control for the stationary contacts of the switching apparatus. However, the same structural arrangement may be provided for movable contacts 8*a*. In such an arrangement, bridge 8 would be constructed of ferromagnetic material, preferably iron, and the plating of copper metal would be disposed on the side of bridge 8 facing the stationary contacts of the apparatus. A rapid runoff of arcs from their point of origin is thereby effected.

In the foregoing specification, the invention has been described with reference to specific exemplary embodiments thereof. It will, however, be evident, that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In an electric switching apparatus including stationary and movable electrical contacts disposed within a housing, an improved contact structure, comprising:

a planar electrical arc conducting member constructed of ferromagnetic material;

an electrical contact member, disposed on one side of said electrical arc conducting member for engagement with an opposing contact of said switching apparatus, and constructed of non-magnetic material; and an electrical line conductor disposed flat on the other side of said electrical arc conducting member and electrically connected to said arc conducting member at a point away from said electrical contact member, said line conductor, said electrical connection between said electrical line conductor and said electrical arc conducting member, and said electrical arc conducting member comprising a coupling arrangement forming a current conducting loop for inducing travel of electrical arcs.

2. The contact structure recited in claim 1, wherein said electrical arc conducting member further comprises a layer of copper metal disposed at least on said side thereof on which said electrical contact member is disposed between said arc conducting member and said contact member.

3. The contact structure recited in claim 1, wherein said electrical arc conducting member further comprises means for mounting said electrical arc conducting member and said electrical contact member within said housing.

4. The contact structure recited in claim 3, wherein said mounting means comprises a stamped member including a keyhole shaped slot affixed to said arc conducting member.

* * * * *